United States Patent [19]

Fluks

[11] 4,242,814

[45] Jan. 6, 1981

[54] CUTTER WHEEL FOR A DREDGING APPARATUS

[75] Inventor: Marten Fluks, Vianen, Netherlands

[73] Assignee: Conrad-Stork B.V., Haarlem, Netherlands

[21] Appl. No.: 14,551

[22] Filed: Feb. 23, 1979

[30] Foreign Application Priority Data

Feb. 27, 1978 [NL] Netherlands ..... 7802151

[51] Int. Cl.[3] ..... E02F 3/88

[52] U.S. Cl. ..... 37/66; 37/189

[58] Field of Search ..... 37/66, 64, 189

[56] References Cited

U.S. PATENT DOCUMENTS 4,083,134 4/1978 Oterdoom ..... 37/66 X

FOREIGN PATENT DOCUMENTS 895627 4/1944 France ..... 37/66

546721 3/1977 U.S.S.R. ..... 37/66

*Primary Examiner*—Clifford D. Crowder

*Attorney, Agent, or Firm*—Haseltine, Lake & Waters

[57] ABSTRACT

A cutter wheel for a dredging apparatus mounted for rotation about a shaft and having outwardly projecting cutting blades mounted on openings formed in the cylindrical peripheral plane of said wheel, while a stationary suction mouth is provided inside said wheel which is adapted for being in fluid communication with the cutting blades on rotation of said wheel, said suction mouth being connected to said shaft so that it may be rotated by means of a piston-cylinder assembly to change its angular position.

5 Claims, 6 Drawing Figures

CUTTER WHEEL FOR A DREDGING APPARATUS

The invention relates to a cutter wheel for a dredging apparatus comprising a flat cylindrical body having one at least partially open flat side and a cylindrical peripheral plane wherein openings are formed arranged at equal distances with respect to each other, on which openings outwardly projecting cutting blades are provided, the said body being adapted for being mounted on the free end of the ladder of the dredging apparatus by means of an approximately horizontally positioned shaft extending along the axis of symmetry of the body and said body being mounted for rotation about this shaft, while in the said body of stationary suction mouth is provided the suction aperture of which being directed to the inner surface of the peripheral plane and connected to the suction pipe of the dredging apparatus by means of a bend-piece extending through the open side of the body to the interior thereof, while means are provided for changing the angular position of the said mouth by rotating this mouth about the axis of the body. A similar cutter wheel is known from French Patent Specification No. 895,627.

In this known cutter wheel the mouth is formed by the bend-piece extending to the interior of the wheel and which opens therein at the lower edge of the wheel, and an approximately radially positioned plate mounted above this opening, the position of said plate being controllable by rotation about the shaft.

The drawback of this cutter wheel is that a poor suction of the material cut loose by means of the cutting blades is obtained, while the angular position of the suction mouth cannot be changed.

In accordance with another embodiment of this known cutter wheel the mouth is formed by two approximately radially arranged plates which moreover form boundaries of the here entirely closed body of the cutter wheel the suction pipe being connected to this body in the centre of the cutter wheel and the body being rigidly attached to the ladder while the blades are arranged for rotation around the body. In this case the angular position of the suction mouth may be changed by rotation about the shaft with respect to the ladder although such a change cannot be brought about when the cutter wheel is in operation below the water surface. Moreover this embodiment entails a rather complicated construction.

The object of the invention is to provide an improved cutter wheel of the above mentioned type.

This object is attained in that in the cutter wheel according to the invention the suction mouth is formed by a box shaped body having an open side forming the suction aperture and shaped in the form of an arc of a circle, which extends at a close distance from the inner surface of the cylindric peripheral plane of the cutter wheel body, while in the side of the box shaped body directed to the open side of the cutter wheel body an opening is provided on which the one open end of the bend-piece is mounted the other end of which being connected to the first end of a flexible tube the second end of which is connected to the suction pipe, the said mouth being connected to the shaft in such a manner that the mouth may be rotated around said shaft and a piston-cylinder unit being provided of which the one end is pivotally attached to the ladder and the other end is connected to the suction mouth.

In this way a good suction action of the material cut loose by means of the blades is obtained while the angular position of the suction mouth may be changed by operating the piston cylinder unit when the cutter wheel is in operation below the water surface.

Advantageously the suction mouth is removably attached to a fastening means which is rotatably connected to the shaft and to which the other end of the piston cylinder unit is pivotally connected.

In this way a suction mouth in which for instance the opening for the connection to the bend-piece is provided in the middle may be replaced by a suction mouth in which this opening is for instance provided at one of the ends of the mouth so that dependent on the nature of the material to be dredged or on the position thereof the most favourable operation of the suction mouth may be obtained.

At the upper and/or lower limit of the suction aperture of the suction mouth a sliding flap may be provided for controlling the surface area of the suction aperture, said sliding flap being operatively connected to a piston cylinder unit in order to obtain an optimal suction intake of the disengaged material.

It should be noted that U.K. Patent Specification No. 1,207,355 describes a cutter wheel the body of which has entirely closed sides and in which body there is provided a suction mouth connected to a fixed shaft said suction mouth being connected to the suction pipe through the shaft. The suction mouth has a predetermined stream lined shape so that the material cut loose by means of the blades first flows through a substantially tangential path, to continue radially and then axially through the shaft to be passed finally through a 90° bend into the suction line, all this resulting in high flow resistances. Moreover it is impossible to change the angular position of the suction mouth during operation below the water surface.

The invention will now further be described in detail with respect to the embodiment shown in the drawing, in which FIG. 1 shows a side elevation of a cutter wheel according the invention;

Figure 1:
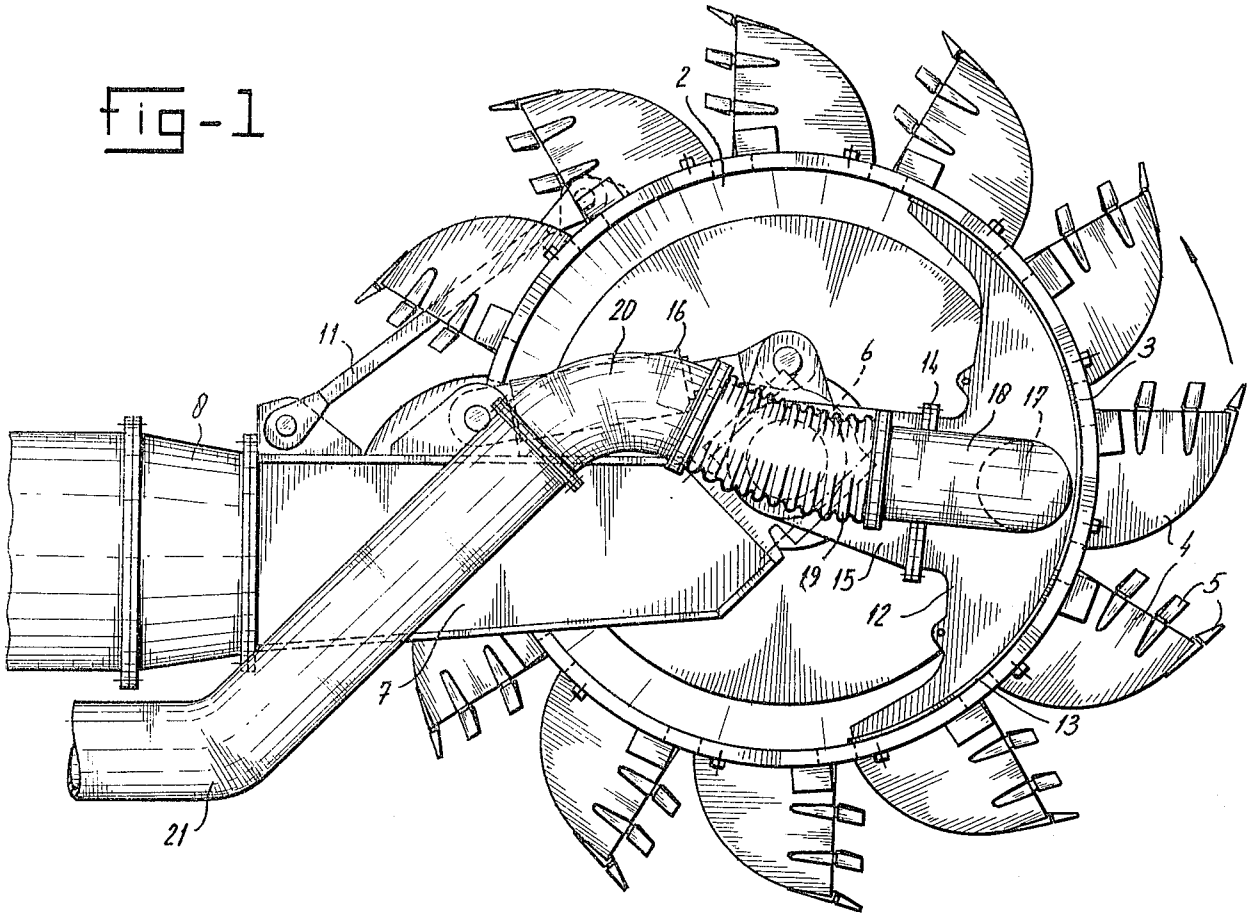
Figure 2:
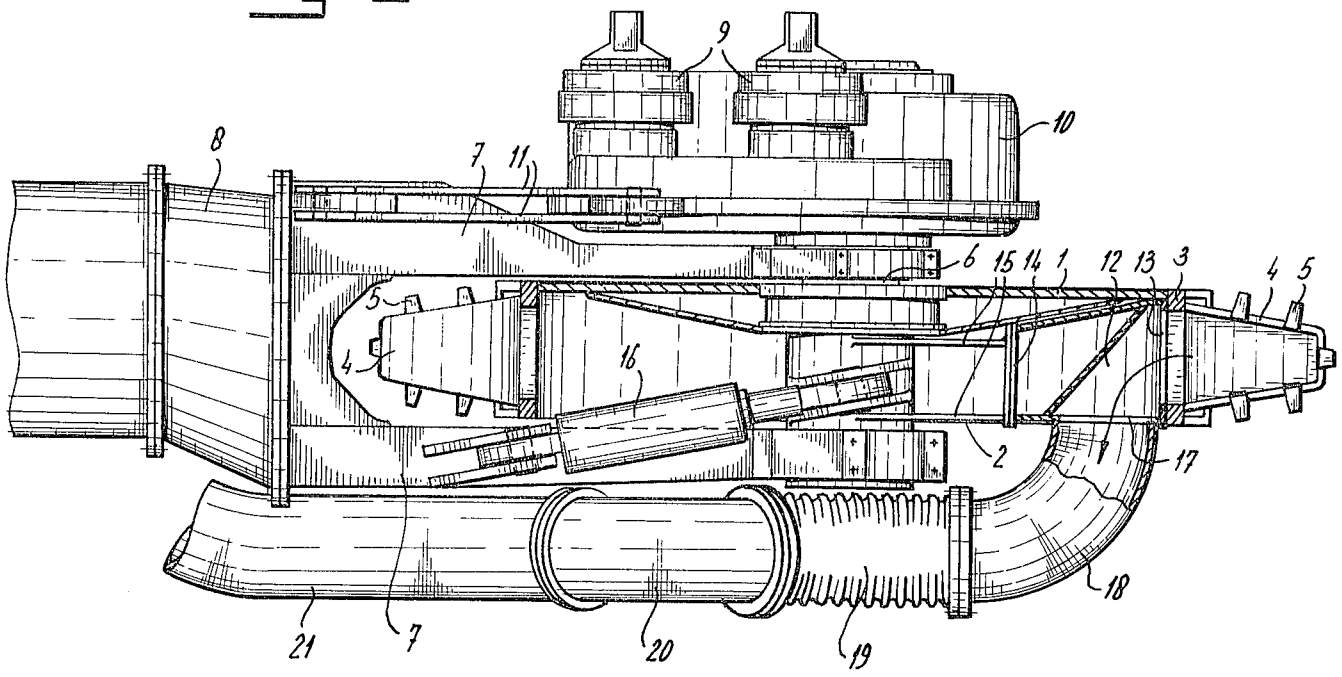
FIG. 2 shows a plan view of the cutter wheel of FIG. 1.

Referring to FIGS. 1 and 2 there is shown a cutter wheel comprising a flat cylindrical body 1 having an at least partially open flat side 2. In the cylindric peripheral plane 3 there are provided openings on which the blades 4 provided with cutting teeth 5 are mounted. The shaft 6 of the cutter wheel is supported by bearings in the forked extremity 7 of the ladder 8. The shaft may be put in rotative motion by means of the hydromotors 9 through the gear housing 10 kept in position by means of the rod 11.

In the body 1 there is mounted a suction mouth 12 in the form of a box shaped body having an open side 13 shaped in the form of an arc of a circle and extending at a close distance from the inner surface of the cylindric peripheral plane of the body 1. By means of a flanged joint 14 the mouth 12 is attached to a fastening means 15 that is mounted on the shaft 6 for rotation. A piston cylinder unit 16 is pivotally connected at its one end to the ladder 7 and at its other end to the fastening means 15 so that in activating the piston cylinder unit 16 the fastening means 15 together with the mouth 12 attached thereto may be rotated with respect to the ladder 7 in order to change the position of the suction mouth 12.

In one of the sides of the mouth 12 there is provided an opening on which a bend 18 is attached the other end of which being connected to a flexible tube 19 that in its turn is connected to the suction pipe 21 by means of a bend 20.

Figure 3:
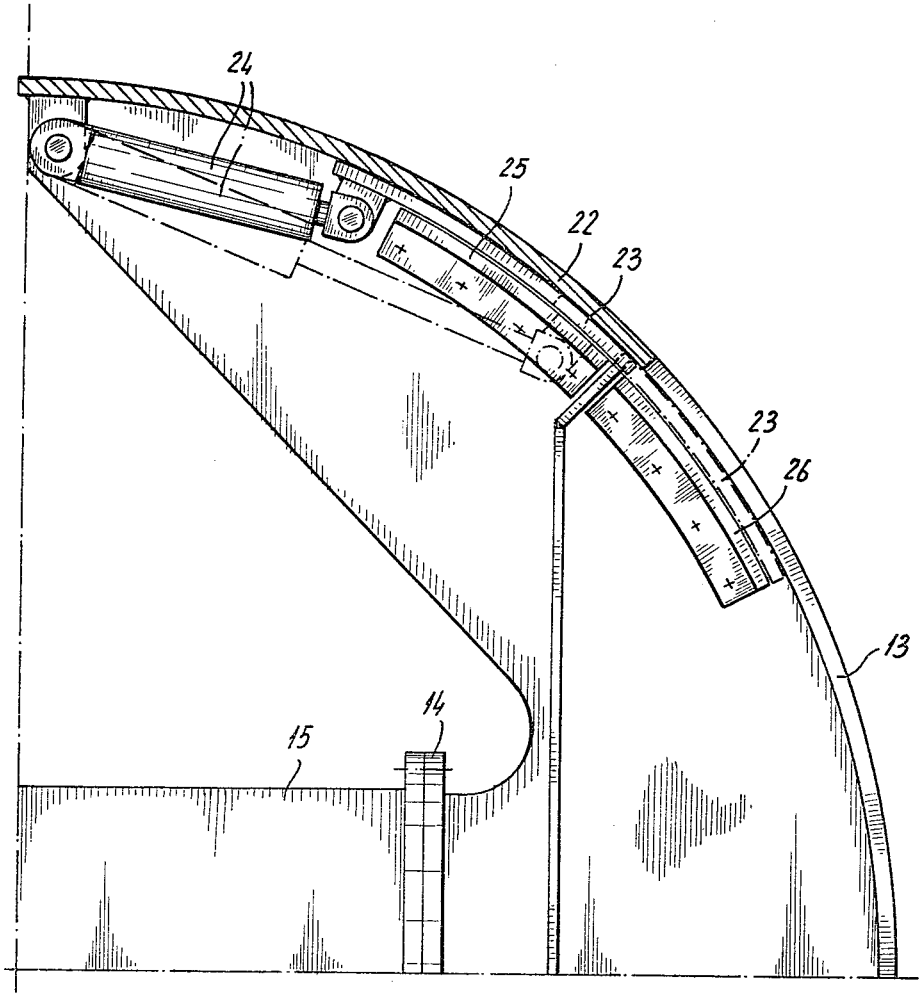
FIG. 3 shows a side elevation of the suction mouth together with the sliding flap provided therein on an enlarged scale.

Referring to FIG. 3 there is provided, at the upper limit of the suction aperture 13, a sliding flap 23 that may be moved by means of the piston cylinder unit 24 from the position shown in full lines to the position shown in dotted lines in order to reduce or to enlarge the area of the suction mouth aperture 13. The sliding flap 23 is guided by the plates 25 and 26.

Figure 4:
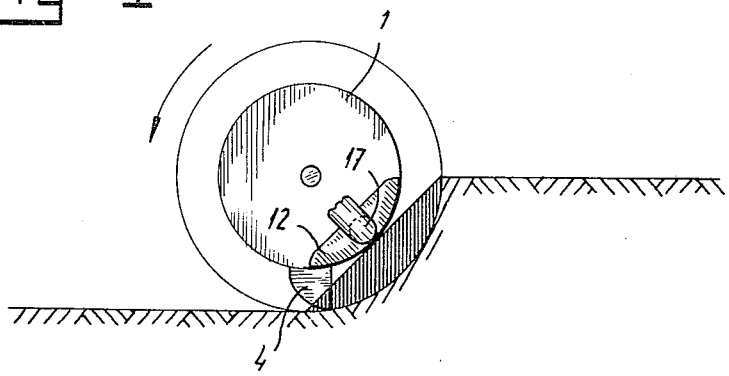
FIGS. 4, 5 and 6 show schematically the operation of the cutter wheel having a suction mouth the connection of which to the suction line is provided at different locations.

The operation of the cutter wheel shown in FIGS. 1, 2 and 3 is schematically shown in FIG 4. The hatched portion in this figure represents the material cut loose by means of a cutting blade 4.

Figure 5:
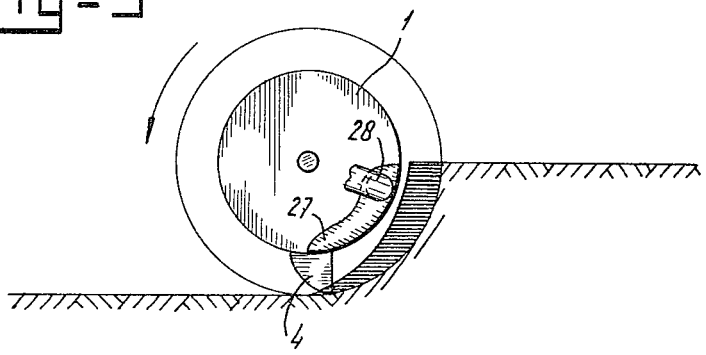

In FIG. 5 there is shown the operation of the cutter wheel in which the suction mouth is replaced by a suction mouth 27 having an opening 28 at the upper part for connection to the suction pipe. In this instance the hatched portion also represents the material cut loose by means of a cutting blade 4 in this instance having a shape different from that shown in FIG. 4.

Figure 6:
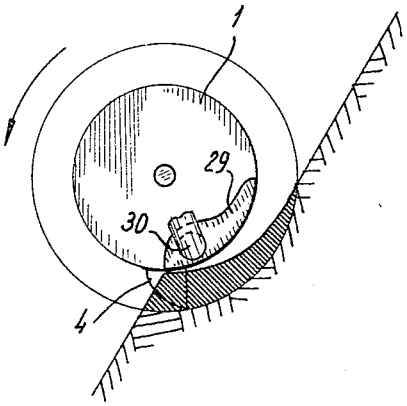

Finally in accordance with FIG. 6 there is provided a mouth 29 in the cutter wheel the opening 30 of which for connection to the suction line is located at its lower part so that a portion of material having again another shape is cut loose by means of a cutting blade.

In that the mouth is removably mounted in the cutter wheel by means of the flanged joint 14, dependent on the prevailing circumstances there may be mounted a mouth of the type 12, 27 or 29 in the cutter wheel, the bend 20 if necessary having to be replaced by a piece having a different shape.

I claim:

1. A cutter wheel for a dredging apparatus having a suction pipe and a ladder comprising a cylindrical body having at least one partially open flat side and a cylindrical circumferential surface including openings arranged at equal distances with respect to each other, on which openings outwardly projecting cutting blades are provided; said body being adapted to be mounted on the free end of the ladder of the dredging apparatus by means of an approximately horizontally positioned shaft extending along the axis of symmetry of the body and said body being mounted for rotation about said shaft, said body having a stationary suction mouth disposed therein provided with a suction aperture being directed to the inner side of the cylindrical circumferential surface and connected to the suction pipe of the dredging apparatus by means of a bent member extending through the open side of the body to the interior thereof, means being provided for changing the angular position of the said mouth by rotation about the axis of symmetry of the body, wherein: the suction mouth is formed of a box shaped body having an open side forming the suction aperture and shaped in the form of an arc of a circle, which is positioned in proximity to the inner side of the cylindrical circumferential surface of the cutter wheel body, an opening being provided in the side of the box shaped body directed to the open side of the cutter wheel body on which the one open end of the bent member is mounted, the other end of which being connected to the first end of a flexible tube, the second end of which is connected to the suction pipe; said mouth being connected to the shaft whereby the mouth is rotatable about said shaft and a piston-cylinder unit being provided having one end pivotally attached to the ladder and the other to the suction mouth.

2. A cutter wheel of claim 1, wherein the suction mouth is removably attached to a fastening means connected to the shaft for rotation and to which the other end of the piston cylinder unit is pivotally connected.

3. The cutter wheel of claim 2, wherein the opening in the side of the mouth is formed near one of the ends of the mouth.

4. The cutter wheel of either claims 1 or 2 or 3, wherein a sliding flap is provided at the upper limit of the suction aperture of the suction mouth for controlling the surface area of the suction aperture, the sliding flap being operatively connected to a piston cylinder unit.

5. The cutter wheel of either claims 1 or 2 or 3, wherein a sliding flap is provided at the lower limit of the suction aperture of the suction mouth for controlling the surface area of the suction aperture, the sliding flap being operatively connected to a piston cylinder unit.

* * * * *